US005593318A

United States Patent [19]

Bilson et al.

[11] Patent Number: 5,593,318

[45] Date of Patent: Jan. 14, 1997

[54] ELECTRICAL RECEPTACLE FOR PHOTOELECTRIC CONTROLLER

[75] Inventors: Edward B. Bilson, Memphis; Mark T. Wedell, Germantown, both of Tenn.; Thomas A. Zimmerman, Southaven, Miss.

[73] Assignee: Thomas & Betts Corporation, Memphis, Tenn.

[21] Appl. No.: 500,385

[22] Filed: Jul. 10, 1995

[51] Int. Cl.[6] ..... H01R 13/73

[52] U.S. Cl. ..... 439/573; 439/565; 439/543; 439/364

[58] Field of Search ..... 439/573, 362, 439/364, 541, 542, 543, 565

[56] References Cited

U.S. PATENT DOCUMENTS

| | | | |
|---|---|---|---|
| 1,259,612 | 3/1918 | Friedel | 439/565 |
| 2,886,630 | 5/1959 | Gill | 174/57 |
| 3,030,605 | 4/1962 | Carissimi | 439/564 |
| 3,160,458 | 3/1962 | Landel et al. | 439/565 |
| 3,187,294 | 5/1963 | Murray et al. | 439/565 |
| 3,719,899 | 11/1975 | Oliver | 372/56 |
| 3,814,834 | 6/1974 | Glader | 174/57 |
| 4,477,143 | 10/1984 | Taylor | 439/559 |

*Primary Examiner*—P. Austin Bradley
*Assistant Examiner*—T. C. Patel
*Attorney, Agent, or Firm*—Michael L. Hoelter; Salvatore J. Abbruzzese

[57] ABSTRACT

An electrical receptacle assembly for attachment to a luminaire housing comprises a housing defining a plurality of contact seating channels extending therethrough along axes parallel to a contact member insertion axis, electrical contact members being seated in the housing channels individually along the axes parallel to the contact member insertion axis. A clamp member is joined to the housing by a threaded fastener. The housing defines an anti-rotation member resident in the clamp member which prevents the clamp member from rotational movement relative to the housing upon tightening the threaded fastener.

15 Claims, 3 Drawing Sheets

ELECTRICAL RECEPTACLE FOR PHOTOELECTRIC CONTROLLER

FIELD OF THE INVENTION

This invention relates Generally to electrical connectors and pertains more particularly to photoelectric controller receptacles for outdoor luminaries.

BACKGROUND OF THE INVENTION

Street lighting luminaries are typically provided with an electrical receptacle for receiving a photoelectric controller on the luminaire housing. The receptacle, which is supported on the top of the housing, is electrically wired into the power supply to the luminaire. A photoelectric controller is plugged into the receptacle when photoelectric control of the luminaire is contemplated. The controller is inserted into the receptacle by applying downward pressure to the controller and thereafter twisting the controller to lock it in place.

Photoelectric controllers, upon insertion to the luminaire receptacle, are preferably orientated in a northerly direction in the north hemisphere to assure that the photoelectric cell operates accurately and for optimum life. In one known receptacle, orientation is achieved by loosening a screw in the top of the receptacle, rotating the receptacle until an arrow or other indicia is aimed generally toward north, and then retighting the screw. Another receptacle design is shown and described in U.S. Pat. No. 4,477,143, issued to Carl D. Taylor, on Oct. 16, 1984. In the '143 design, the receptacle is resiliently attached to the housing surface by a snap ring. By lifting the receptacle, keying pins and recesses in the receptacle and housing are disengaged and the receptacle may be turned to a different orientation. During the lifting of the photoeleetric controller, the receptacle may also be inadvertently lifted and disadvantageously rotated whereby the original northern orientation may be lost.

SUMMARY OF THE INVENTION

The primary object of the present invention is the provision of an improved receptacle for use with a photoelectric controller.

A further object of the present invention is the provision of a photoelectric control receptacle assembly for attachment to a luminaire housing.

In a particular form of the present invention, the photoelectric control assembly comprises an insulative housing having a plurality of contact seating channels extending therethrough along axes parallel to a contact member insertion axis, the housing defining an anti-rotation member extending from a surface thereof. A plurality of electrical contact members are seated in the housing channels individually along the axis parallel to the contact member insertion axis. A clamp member is provided for securing the receptacle assembly to a luminaire housing, the clamp member defining a surface in engagement with the housing anti-rotation member. A fastener is included for joining the housing and clamp member, the clamp member being prevented from rotational movement relative to the housing as a result of the engagement between the housing clamp surface and the housing anti-rotational member.

The receptacle in preferred form, comprises an integral insulative housing formed of one-piece plastic having a plurality of contact seating channels extending therethrough along axes parallel to a contact member insertion axes, the housing having a central bore therethrough for receipt of a fastener therein. The housing defines a projecting anti-rotation member for engagement with a clamp member to prevent relative rotation between the clamp member and the housing. A stop surface is provided for engagement with the clamp member to prevent deformation of the clamp member of upon joinder with the fastener. A plurality of electrical contact members are seated in the housing channels individually along the axes parallel to the contact member insertion axis.

The foregoing and other objects and features of the invention will be further understood from the following detailed discussion of preferred practices and embodiments thereof and from the drawings wherein like reference numerals identify like components and parts throughout.

BRIEF DESCRIPTION OF THE DRAWING FIGURES

DETAILED DESCRIPTION OF THE PREFERRED EMBODIMENT AND PRACTICES

Figure 1:
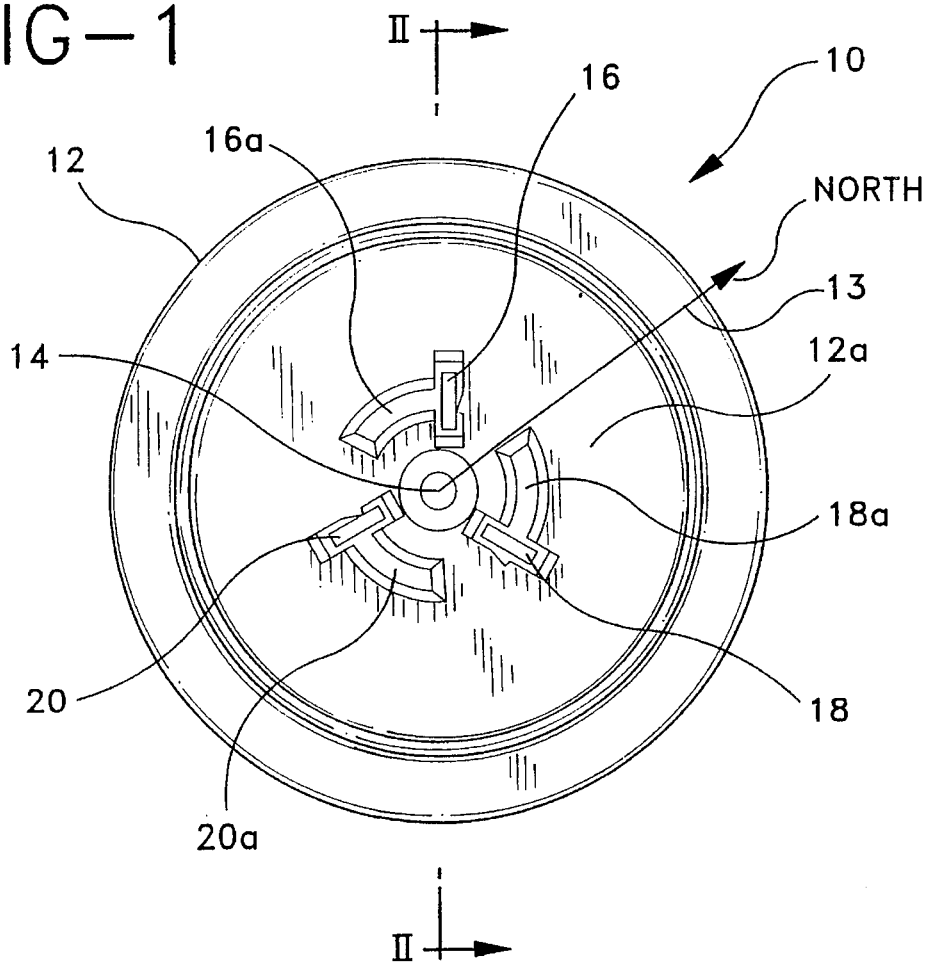
FIG. 1 is a top plan view of a receptacle in accordance with the invention.

Referring to FIG. 1, photoelectric controller (PEC) receptacle 10 comprises a housing 12 having a central bore 14 disposed therethrough. Housing 12 seats female contacts 16, 18 and 20 in registry with male contact receiving slots 16*a*, 18*a*, and 20*a*. Male contacts (not shown) of known PEC type have contact blades configured in common with slots 16*a*, 18*a*, and 20*a*, i.e., having a rectangular portion followed centrally by an arcuate follower. Upper surface 12*a* including thereon an indicia, such as arrow 13 and the word "north" for orienting the receptacle 10 such that the controller (not shown) will preferably have its sensor pointing in the northerly direction.

Figure 2:
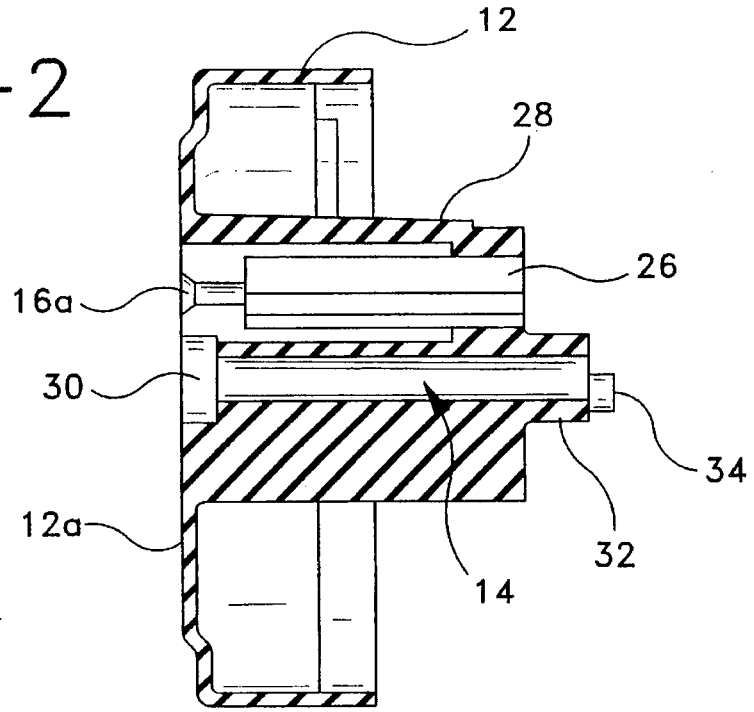
FIG. 2 is a sectional view of the housing of the receptacle of FIG. 1 as would be seen from plane II—II of FIG. 1.
Figure 3:
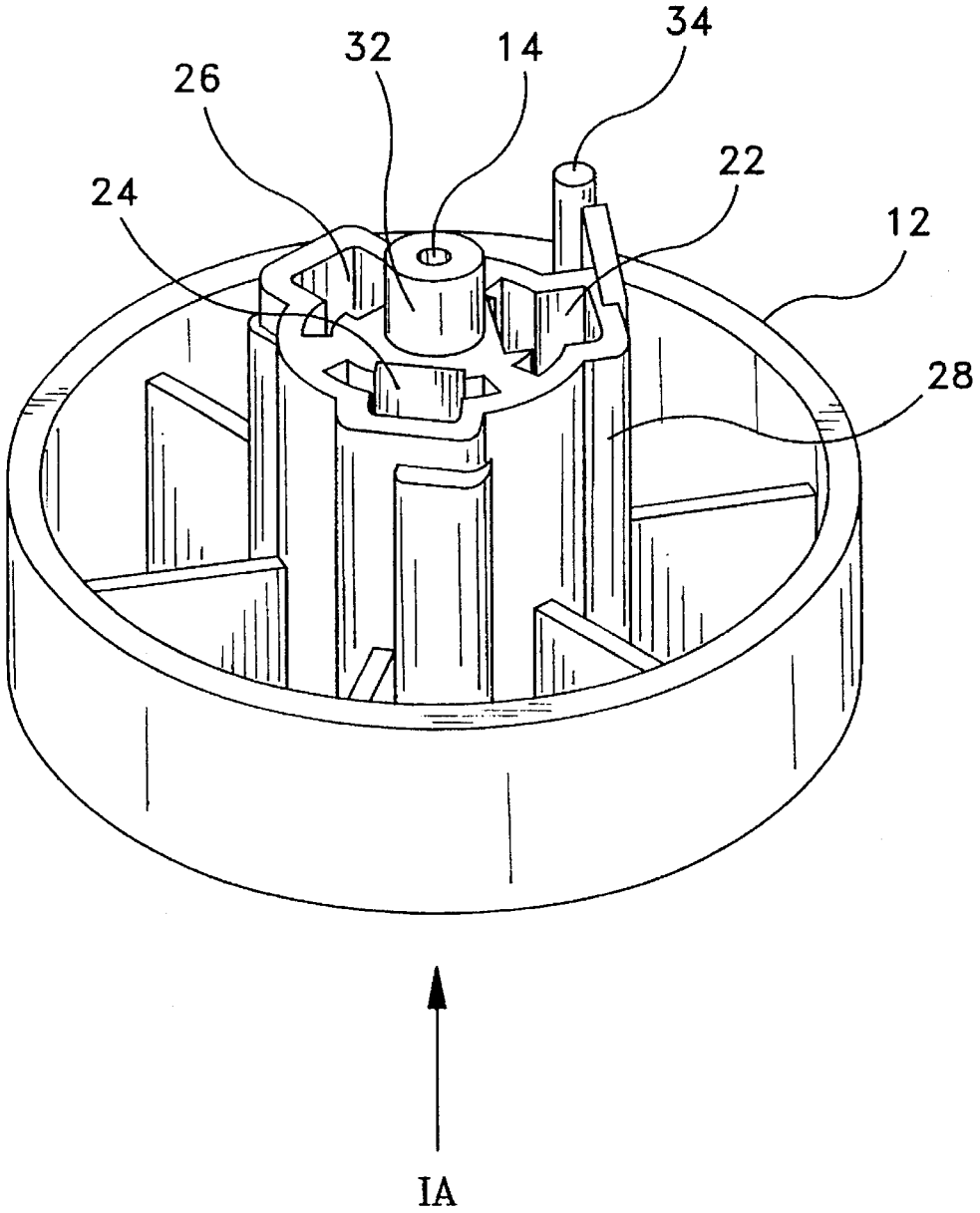
FIG. 3 is an underside perspective view of the receptacle of FIG. 1.

Turning to FIGS. 2 and 3, housing 12, which is comprised of electrically insulative material, defines a plurality of channels 22, 24 and 26 extending through a hub 28 along axes parallel to a contact member insertion axis IA for respectively individually seating electrical contact members 16, 18 and 20 along axes parallel to the contact member insertion axis. Hub extension 32 is central to housing 12 and with hub 28 defines the central bore 14. A counterbore 30 is formed in alignment with bore 14, counterbore 30 extending within upper surface 12*a* as shown in FIG. 2. Anti-rotation member 34 extends rearwardly and outwardly from a bottom surface of housing 12 beyond hub extension 32. Housing 12 is preferably integrally formed of plastic.

Figure 4:
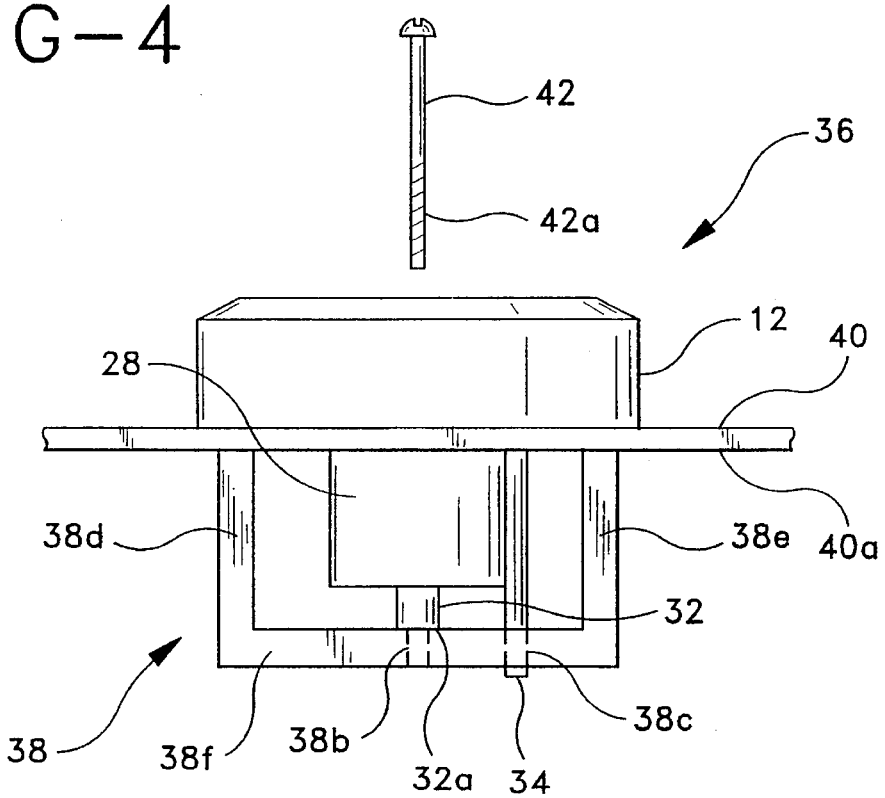
FIG. 4 is a showing of the receptacle of FIG. 1 in assembly with a support substrate, with the assembly screw being in exploded view.
Figure 5:
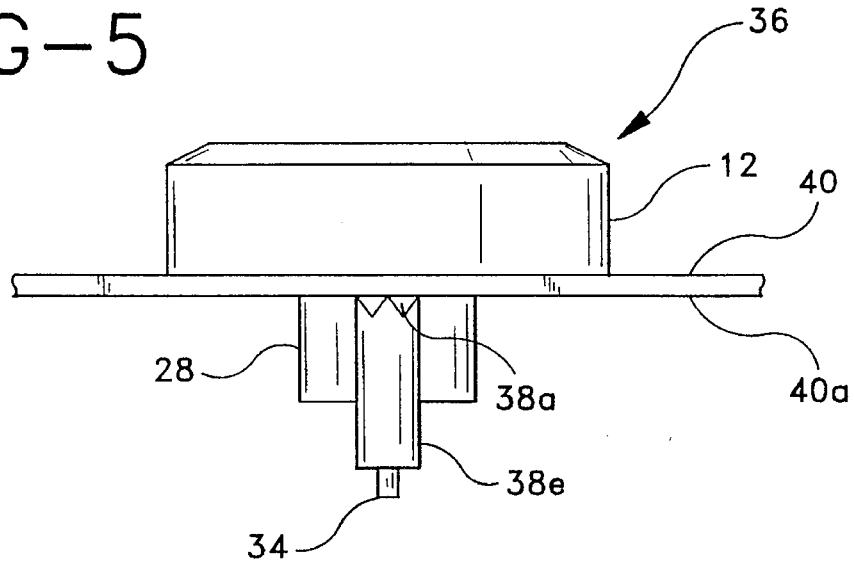
FIG. 5 is a right side view of the receptacle assembly of FIG. 4.
Figure 6:
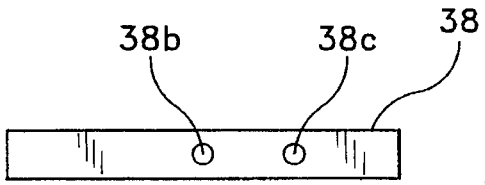
FIG. 6 is a bottom plan view of the receptacle clamp of the assembly illustrated in FIG. 4.

Turning to FIG. 4, receptacle assembly 36 comprises receptacle 10 and a clamp member 38 mountable on the top surface 40 of the luminaire housing, which is typically an aluminum casting. Clamp member 38 has serrated teeth 38*a* (FIG. 5) in facing relation to housing surface 40 and includes a central opening 38*b* and an offset opening 38*c*, as shown in FIG. 6. Opening 38*b* is a smooth opening for receiving a self-tapping assembly screw 42, which is inserted through receptacle bore 14. Self tapping threads 42*a* form internal threads in clamp opening 38*b* during insertion thereto. Alternatively, opening 38*b* may be internally threaded initially for receipt of screw threads 42*a*. Anti-rotation member 34 is of extent to be freely received in offset clamp opening 38*c* upon assembly of the receptacle housing 12 to the luminaire housing surface 40. Clamp member 38 is preferably formed of metal and is of generally U-shaped configuration with upstanding legs 38*d* and 38*e* extending upwardly from a horizontal bar 38*f* as shown in FIGS. 4 and 5.

Upon assembly of the receptacle 10 to the luminaire housing 40, the assembly screw 42 is inserted through the receptacle bore 14 such that the self-tapping threads 42*a* are initially inserted into the clamp opening 38*b*. The clamp is positioned onto the bottom of the receptacle housing such that the offset opening 38*c* receives the anti-rotation member 34 therein. Upon tightening of the screw 42 into the clamped opening 38*b*, the clamp 38 is drawn upwardly until the serrated teeth bitingly engage the under surface 40*a* of the luminaire housing 40. Insertion of the anti-rotation member 34 into clamp opening 38*c* prevents rotation of the housing receptacle relative to the clamp 38, thereby maintaining the position of the receptacle in the northerly direction. Additionally, as the clamp is drawn up against the lower surface 40*a*, the clamp 38 bottoms-out against the lower surface 32*a* of the hub extension 32, as shown in FIG. 4, thereby preventing deformation due to over torquing and thereby maintaining the serrated teeth 38*a* in engagement with the lower housing surface 40*a* and preventing loss of receptacle orientation. As so mounted, the receptacle may now receive a photoelectric controller, such as that shown in U.S. Pat. No. 4,477,143 and be positioned with its sensor pointed in the direction of arrow 13 such that the sensor will be oriented in the northerly direction.

In addition, the photoelectric controller may be changed or replaced without loss of the northerly orientation during such changes or replacement. Upon removal of the controller, as the clamp retains its grip on the undersurface 40*a* of the luminaire housing, rotation of the controller to effect its removal will not cause the receptacle to move from its previous orientation.

Various changes to the particularly disclosed embodiments and methods may evidently be introduced without departing from the invention. Accordingly, it is to be appreciated that the particularly described preferred embodiments and practices of the invention are intended in an illustrative and not in a limiting sense. The true scope of the invention is set forth in the ensuing claims.

What is claimed is:

1. A photoelectric control receptacle assembly for attachment to a luminaire housing, the receptacle assembly comprising:

an insulative body having a plurality of contact seating channels extending therethrough along axes parallel to a contact member insertion axis, said body defining a projecting anti-rotation member extending rearwardly from a bottom surface thereof and parallel to the contact member insertion axis;

a plurality of electrical contact members seated in said housing channels individually along said axes parallel to said contact member insertion axis;

a clamp member for securing said receptacle assembly to the luminaire housing, said clamp member having means in engagement with said body anti-rotation member; and, a fastener for joining said body and said clamp member, said clamp member being prevented from rotational movement relative to said body as a result of said engagement between said clamp surface and said body anti-rotational member.

2. An assembly according to claim 1, wherein said clamp member comprises a generally U-shaped member having a pair of opposed, parallel upstanding legs, the distal ends of which are adapted to engage said luminaire housing.

3. An assembly according to claim 2, wherein said clamp member comprises a base from which said legs extend, said base comprising said surface in engagement with said anti-rotation member.

4. An assembly according to claim 3, wherein said base has a first opening for secured receipt of said fastener therein.

5. An assembly according to claim 4, wherein said base has a second opening for receipt of said housing anti-rotation member therein.

6. An assembly according to claim 5, wherein said housing further defines a stop surface in engagement with said clamp member base to prevent over-deformation of said clamp member upon activation of said fastener.

7. An assembly according to claim 6, wherein said fastener comprises self-tapping threads for insertion into said bore first opening.

8. An assembly according to claim 7, wherein said distal ends of said upstanding legs comprise serrated teeth.

9. A receptacle for use with a photoelectric controller, comprising:

an integral insulative housing formed of one-piece plastic having a plurality of contact seating channels extending therethrough along axes parallel to a contact member insertion axis, said housing having a central bore therethrough for receipt of a fastener therein, said housing defining a projecting anti-rotation member extending rearwardly from a bottom surface thereof and parallel to the contact member insertion axis, a clamp member having means in engagement with the housing anti-rotation member to prevent relative rotation between said clamp member and said housing, and a stop surface for engagement with said clamp member to prevent deformation of said clamp member upon joinder with said fastener; and a plurality of electrical contact members seated in said housing channels individually along said axes parallel to said contact member insertion axis.

10. A receptacle according to claim 9, wherein said housing is generally cylindrical.

11. A receptacle according to claim 10, wherein said housing comprises an upper surface including indicia thereon for orienting said housing in a predetermined direction.

12. A receptacle according to claim 11, wherein said stop surface communicates with said central bore and lies substantially perpendicular thereto, said stop surface being spaced from said upper surface and lying generally parallel thereto.

13. A receptacle according to claim 12, wherein said anti-rotation member projects outwardly beyond said stop surface in a direction generally parallel of said central bore and offset relative thereto.

14. A photoelectric control receptacle assembly for attachment to a luminaire housing, the receptacle assembly comprising:

an insulative body having a plurality of contact seating channels extending therethrough along axes parallel to a contact member insertion axis, said body defining a projecting anti-rotation member extending rearwardly from a bottom surface thereof and parallel to the contact member insertion axis;

a plurality of electrical contact members seated in said housing channels individually along said axes parallel to said contact member insertion axis;

a clamp member for securing said receptacle assembly to the luminaire housing, said clamp member having means in engagement with said body anti-rotation member; and, a fastener for joining said body and said clamp member, said clamp member being prevented from rotational movement relative to said body as a result of said engagement between said clamp surface and said body anti-rotational member, said clamp member further including anti-rotational means thereon for engagement with said luminaire housing, the clamp member anti-rotational means preventing rotational movement of said clamp member relative to said luminaire housing.

15. An assembly according to claim 14, wherein said clamp member anti-rotational means comprises locking teeth which engage the luminaire housing.

* * * * *